United States Patent [19]

Sather

[11] 4,326,457

[45] Apr. 27, 1982

[54] CAN CRUSHING APPARATUS

[76] Inventor: George A. Sather, Box 217, Soquel, Calif. 95073

[21] Appl. No.: 153,835

[22] Filed: May 27, 1980

[51] Int. Cl.[3] ..... B30B 9/32; B30B 15/32

[52] U.S. Cl. ..... 100/218; 100/902

[58] Field of Search ..... 294/1 R; 100/DIG. 2, 100/233, 288, 98 R, 293, 295, 283, 249, 245, 218, 240

[56] References Cited

U.S. PATENT DOCUMENTS

| | | | |
|---|---|---|---|
| 3,411,722 | 11/1968 | Webber | 100/DIG. 2 |
| 4,062,283 | 12/1977 | Kaminski | 100/DIG. 2 |
| 4,168,661 | 9/1979 | Wigdahl | 100/245 |

*Primary Examiner*—James B. Marbert

*Attorney, Agent, or Firm*—Arthur L. Urban

[57] ABSTRACT

Can crushing apparatus including a base portion, a can holding portion, a crusher portion, and a crusher actuating portion; the can holding portion extending upwardly from the base portion, the can holding portion including a can retaining section, the can retaining section including a can receiving opening adjacent the upper end of the can retaining section, a crushed can outlet opening adjacent the lower end of the can retaining section; the crusher portion including a piston, a piston rod having one end connected to the piston and the opposite end thereof connected to the crusher actuating portion, the piston rod being of a length greater than the length of the can retaining section; the crusher actuating portion including a support section extending upwardly from the base portion adjacent to the can retaining section, a handle member having one end thereof pivotally connected to the upper end of the support section and extending from the support section over the upper end of the can retaining section and substantially beyond the can retaining section, the upper end of the piston rod being pivotally connected to the handle member along the length thereof, the handle member being pivotable about its pivot point with the support section from a position adjacent the can retaining section in which the piston is disposed adjacent the outlet opening of the can retaining section to a position remote from the can retaining section in which the piston is spaced from the can receiving opening of the can retaining section.

8 Claims, 4 Drawing Figures

CAN CRUSHING APPARATUS

This invention relates to a novel crushing apparatus and more particularly relates to a new apparatus for crushing cans.

The disposal of trash and waste has been a problem for many years. When most people lived in rural areas, each family took care of its own waste disposal. Generally, the trash was simply placed in an inconspicuous location on the family property and the elements allowed to decompose the trash. After a few years, the decomposable materials had been eliminated and only the scrap metal remained. If the quantity of metal was too large, a tractor or other vehicle was run back and forth over the pile to compress it.

While such trash disposal methods were satisfactory when families lived at some distance from each other, as homes were located closer together, a trash pile which was inconspicuous to the owner of the property could be an eyesore to an adjoining neighbor. As a result, the location of a trash pile might create strains in the relationships between neighbors. In an attempt to minimize such problems, some property owners erected fences or planted shrubbery to screen their trash pile from adjoining neighbors.

Although the use of screening materials reduces the severity of the visual aspects of trash piles, it does not eliminate the odor and rodent problems. Because rodents can spread disease, trash disposal problems not only are the concern of a family and its immediate neighbors, but also various government agencies become involved in the exercise of their jurisdiction over public health.

With the joint efforts of the government, various civic groups and individuals, laws have been approved which control trash disposal. Generally, governmental authorities have established trash collection procedures which involve the regular collection of the trash and the dumping of the trash at a central dumping facility.

While the disposal of trash at central dumping facilities provides a satisfactory solution where usable land is available relatively close to the trash sources, it often is only a temporary solution. As one dumping site is filled, another must be made available. If the population of an area is increasing, new sites at reasonable distances may be difficult to find. Also, if the site is too close to residences, the people may complain about rodent infestation as well as air pollution.

Attempts to solve these problems generally have resulted in the creation of sanitary landfills. Such landfills cover the trash with a layer of soil immediately after the dumping. This solution may reduce the problems described above but it does not eliminate them. Thus, complaints still may be voiced.

With the increasing price of various materials commonly discarded as trash, there has been greater interest in recovering such materials. The recovery may be accomplished at the dumping site and/or at a recycling center. In the former case, the dump employees or scavenging individuals may do the separation. Recycling centers generally have employees or volunteers to do the work with the profits going to the sponsoring organization.

Some recycling centers are paying for recyclable trash which has been pre-sorted. For example, aluminum beverage cans are being collected for their salvage value. One of the problems in the collection of beverage cans is the space taken by each can. The individual collecting the cans has to have a large area in which to store the cans until he can take them to the recycling center.

In order to reduce the space for each can, many people crush the cans with their feet or with other tools such as hammers. Crushing cans with one's feet may be effective for men or other individuals with strength, but many people including the elderly and children, who might be interested in the extra income, may have insufficient strength to crush the cans. Also, the use of a hammer or sledge may be tiring to such persons as well as present a safety hazard. In either situation, such can crushing methods are slow and achieve haphazard results.

The present invention provides a novel can crushing apparatus that crushes cans simply and quickly. The can crushing apparatus of the invention requires a minimum of strength so it can be used successfully by women, children and the elderly as well as men. Furthermore, the apparatus crushes the can in a single stroke of the apparatus. In addition, the apparatus can be loaded conveniently. Thus, a larger quantity of cans can be crushed in a given period of time as compared with foot or hammer crushing.

The can crushing apparatus of the invention crushes cans longitudinally of their axis so that the crushed slug is of smaller size than achieved with transverse crushing with a foot or a hammer. As a result, a greater number of crushed cans can be stored in a given space. Thus, fewer trips to the recycling center are required.

The can crushing apparatus of the invention is simple in design and can be manufactured relatively inexpensively. The apparatus of the invention can be fabricated from commercially available components and materials using conventional metal working techniques with semi-skilled labor.

Other benefits and advantages of the novel can crushing apparatus of the present invention will be apparent from the following description and the accompanying drawings in which.

Figure 1:
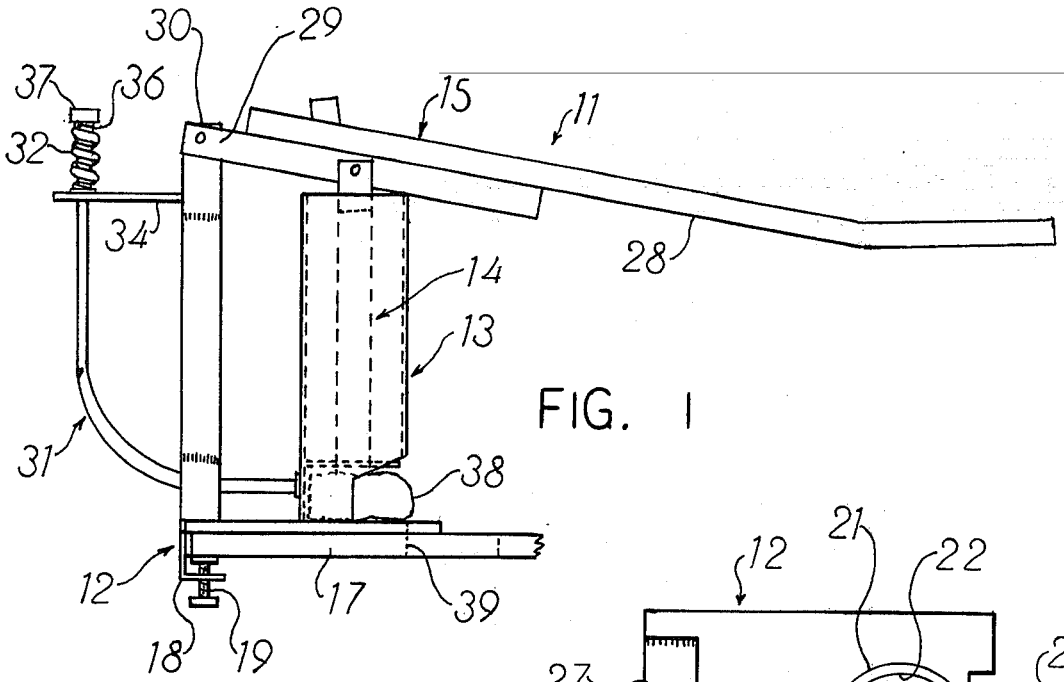
FIG. 1 is a side elevation of one form of the can crushing apparatus of the invention.
Figure 2:
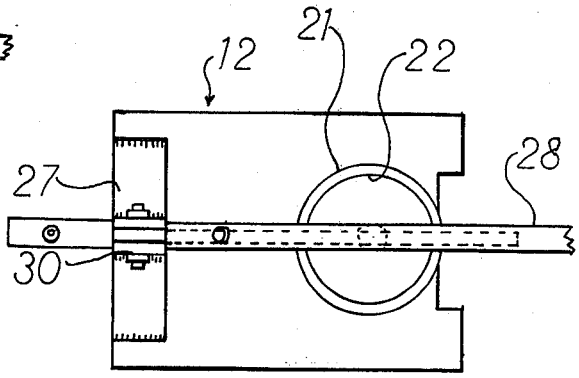
FIG. 2 is a fragmentary top view of the can crushing apparatus shown in FIG. 1.
Figure 3:
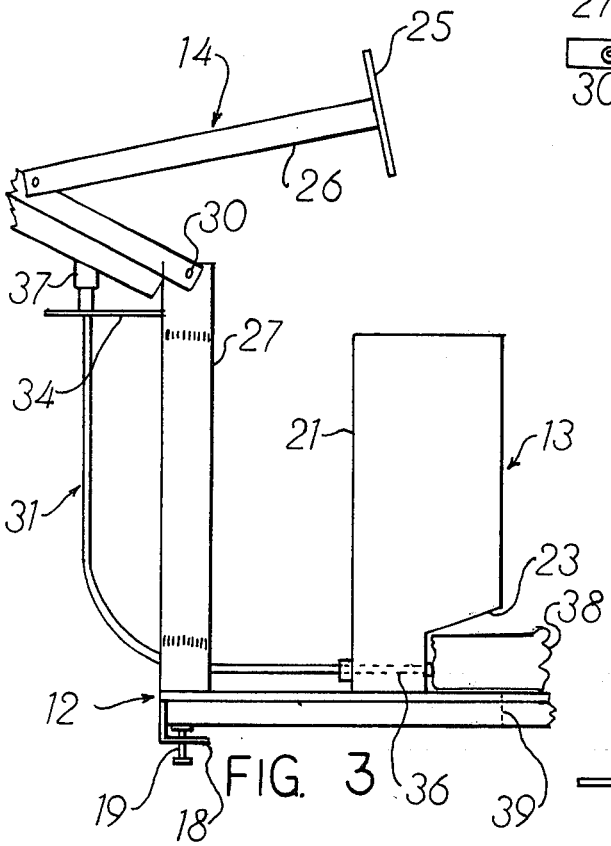
FIG. 3 is an enlarged fragmentary side view of the can crushing apparatus shown in FIG. 1 with the piston withdrawn from the can retainer and a crushed can being ejected.
Figure 4:
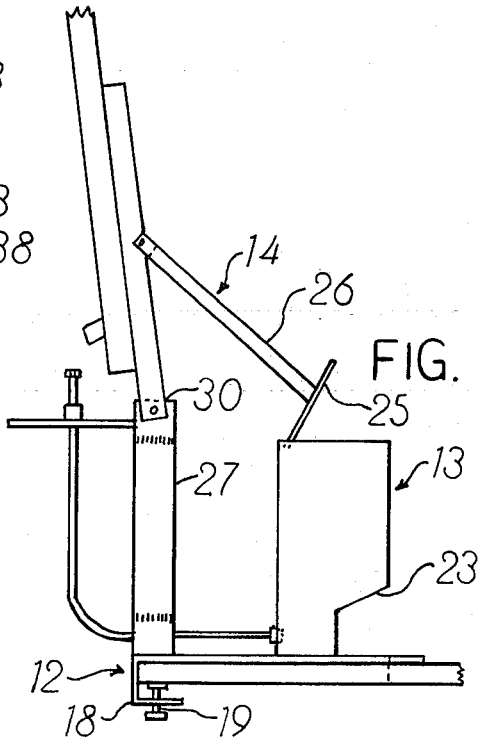
FIG. 4 is a side view of the can crushing apparatus shown in FIG. 1 at the beginning of the down stroke and the piston entering the can retainer.

As shown in the drawings, one form of the novel can crushing apparatus 11 of the present invention includes a base portion 12 with a can holding portion 13 extending upwardly therefrom. Also, included in the apparatus 11 is a crusher portion 14 and a crusher actuator portion 15. Advantageously, the base portion 12 includes means for attaching the apparatus to a work surface 17. The attaching means may include a bracket 18 and a screw 19 adjustable therein which form a clamp.

The can holding portion 13 includes a can retaining section 21. The can retaining section 21 has a can receiving opening 22 adjacent the upper end of the can retaining section. A crushed can outlet opening 23 is located adjacent the lower end of the can retaining section 21. Preferably, the can retaining section is of a generally cylindrical configuration as shown in the drawings.

The crusher portion 14 includes a piston 25 and a piston rod 26 having one end thereof connected to the piston. The opposite end of piston rod 26 is connected to the crusher actuating portion 15 as will be described hereinafter. Piston rod 26 is of a length greater than the length of the can retaining section 21.

Crusher actuator portion 15 includes a support section 27 extending upwardly from base portion 12 adjacent to the can retaining section 21. A handle member 28 has one end 29 thereof pivotally connected to the upper end 30 of the support section 27. The handle member 28 extends from the support section 27 over the upper end of the can retaining section 21 and substantially beyond it. The upper end of the piston rod 26 is pivotally connected to the handle member 28 along the length thereof.

The can crushing apparatus of the invention also advantageously includes means for ejecting a crushed can from the outlet opening 23 of the can retaining section 21. As shown, the ejecting means may include a movable member 31 having one end thereof adjacent to the outlet opening 23 of the can retaining section 21. The opposite end of the movable member 31 is disposed adjacent to the upper end of the A support section 27. Preferably, biasing means is disposed adjacent the upper end of movable member 31.

Movable member 31 advantageously as shown includes a fixed sheath portion 33 the upper end of which is held in place by bracket 34 extending from support section 27. The lower end of fixed sheath portion 33 is affixed to the lower part of can retaining section 21 opposite outlet opening 23. A flexible ejection portion 36 is disposed within fixed sheath portion 33. The ejection portion 36 is longer than fixed sheath portion 33 with the upper end of the ejection portion normally extending beyond the upper opening of the sheath portion. The lower end of the ejection portion 36 is extendable toward the outlet opening 23, and thus moves from one side of the can retaining section 21 to the other.

The biasing means shown as captive coil spring 32 is disposed around the exposed end of the ejection portion 36 and bears against bracket 34 and an enlarged end 37 on the ejection portion 36. The coil spring 32 urges the ejection portion 36 upwardly to maintain the lower end of the movable member free of the outlet opening 23 except when needed.

In the operation of the novel can crushing apparatus 11 shown in the drawings, the apparatus first is positioned on a work surface 17 such as a table and the screw 19 tightened against the underside of the work surface to secure the apparatus in place.

Next, handle member 28 is raised a sufficient distance so that piston 25 and piston rod 26 are completely withdrawn from the can retaining section 21. A can to be crushed then is inserted into the upper can receiving opening 22 of the section 21. Thereafter, handle member 28 is returned toward its original position causing piston 25 to move back into the opening 22 of the can receiving section 21.

Movement of the handle member 28 is continued in a downward direction so that piston 25 is moved downwardly in can retaining section 21. This movement of the piston 25 causes it to push downwardly on the top of the can in the can retaining section 21. Additional force applied to handle member 28 is transmitted to piston 25 forcing the top of the can downwardly and crushing the can into a compressed slug 38.

To remove the crushed slug 38 from the apparatus, handle member 28 is raised and swung in an arc until the top of the handle member contacts the upper end 37 of ejection portion 36. Continued movement of handle member 28 overcomes the resistance of spring 32 allowing the ejection portion 36 to move along sheath portion 33 causing the lower end of the ejection portion to move from one side of the can retaining section 21 to the other. During this movement, the lower end of the ejection portion 36 will push the slug 38 from the outlet opening 23 of the can retaining section 21 preferably through an opening 39 in work surface 17 to clear the chamber for the next can.

Another can may be inserted into the upper opening 22 since the piston 25 is now separated from the can retaining section 21. Then the operation is repeated by lowering the handle member 28 to compress the can. Thereafter, the handle member 28 is raised and swung backward until it bears against the upper end of the ejecting mechanism to discharge the crushed slug and permit the placement of another can into the can retaining section 21. The cycle is repeated until all of the cans are crushed. A container (not shown) can be placed under opening 39 in the work surface 17 to collect the crushed cans.

The above description and the accompanying drawings show that the present invention provides a novel can crushing apparatus that is capable of crushing cans quickly and with a minimum of effort. Since the can crushing apparatus of the invention can be operated easily, it can be used successfully by women, children and the elderly, as well as men. The crushing apparatus can be loaded conveniently and can crush a can in a single stroke. As a result, a large quantity of cans can be crushed in a given period of time without fatigue.

Since the crushing apparatus of the present invention crushes cans longitudinally of their axis, the crushed slug is of small size. Therefore, more crushed cans can be stored in a given space and fewer trips to the recycling center are required.

The can crushing apparatus of the invention is simple in design and can be fabricated from commercially available components and materials using conventional metal fabricating techniques. Also, the can crushing apparatus can be manufactured relatively inexpensively.

It will be apparent that various modifications can be made in the particular can crushing apparatus described in detail above and shown in the drawings within the scope of the invention. For example, the size and configuration of components can be changed to meet specific requirements. Also, the apparatus of the invention can be fabricated from a variety of materials including metals, wood, plastic and the like. In addition, the means for attaching the apparatus to a work surface and ejecting the crushed cans can be different as desired. Therefore, the scope of the invention is to be limited only by the following claims.

What is claimed is:

1. Can crushing apparatus including a base portion, a can holding portion, a crusher portion, and a crusher actuating portion; said can holding portion extending upwardly from said base portion, said can holding portion including a can retaining section, said can retaining section including a can receiving opening adjacent the upper end of said can retaining section, a crushed can outlet opening adjacent the lower end of said can retaining section; said crusher portion including a piston, a piston rod having one end connected to said piston and the opposite end thereof connected to said crusher actuating portion, said piston rod being of a length greater than the length of said can retaining section; said crusher actuating portion including a support section extending upwardly from said base portion adjacent to said can retaining section, a handle member having one end thereof pivotally connected to the upper end of said support section and extending from said support section over the upper end of said can retaining section and substantially beyond said can retaining section, the upper end of said piston rod being pivotally connected to said handle member along the length thereof, said handle member being pivotable about its pivot point with said support section from a position adjacent said can retaining section in which said piston is disposed adjacent said outlet opening of said can retaining section to a position remote from said can retaining section in which said piston is spaced from said can receiving opening of said can retaining section, and means for ejecting a crushed can from said outlet opening including a movable member having one end thereof adjacent to said outlet opening of said can retaining section and the opposite end thereof adjacent to the upper end of said support section.

2. Can crushing apparatus according to claim 1 wherein said can retaining section is of a generally cylindrical configuration.

3. Can crushing apparatus according to claim 1 wherein said base portion includes means for attaching said apparatus to a work surface.

4. Can crushing apparatus according to claim 1 wherein said end of said movable member adjacent to said upper end of said support section includes biasing means.

5. Can crushing apparatus according to claim 1 wherein said handle member is pivotable into a position whereby said handle member engages the upper end of said movable member.

6. Can crushing apparatus according to claim 1 wherein said movable member includes a flexible portion slidably disposed within a sheath portion.

7. Can crushing apparatus according to claim 1 wherein said crushed can outlet opening is located at the bottom of said can retaining section and extends around a portion of the periphery thereof.

8. Can crushing apparatus according to claim 1 including means for transferring said ejected crushed can away from said apparatus.

* * * * *